US009121134B2

(12) United States Patent
Wernersson et al.

(10) Patent No.: US 9,121,134 B2
(45) Date of Patent: Sep. 1, 2015

(54) PROCESS FOR PRODUCTION OF OXIDISED CELLULOSE PULP

(75) Inventors: Fredrik Wernersson, Vastra Frolunda (SE); Harald Brelid, Gothenburg (SE); Hans Theliander, Gothenburg (SE); Kristoffer Lund, Gothenburg (SE)

(73) Assignee: Sodra Skogsagarna Ekonomisk Forening, Vaxjo (SE)

( * ) Notice: Subject to any disclaimer, the term of this patent is extended or adjusted under 35 U.S.C. 154(b) by 329 days.

(21) Appl. No.: 13/522,900

(22) PCT Filed: Jan. 18, 2011

(86) PCT No.: PCT/EP2011/050629

§ 371 (c)(1),
(2), (4) Date: Oct. 9, 2012

(87) PCT Pub. No.: WO2011/089123

PCT Pub. Date: Jul. 28, 2011

(65) Prior Publication Data

US 2013/0025807 A1 Jan. 31, 2013

(30) Foreign Application Priority Data

Jan. 19, 2010 (WO) ..... PCT/EP2010/050581

(51) Int. Cl.

| | |
|---|---|
| ***D21C 9/00*** | (2006.01) |
| ***D21H 11/20*** | (2006.01) |
| ***D21H 27/00*** | (2006.01) |

(52) U.S. Cl.

CPC ..... *D21C 9/002* (2013.01); *D21H 11/20* (2013.01); *D21C 9/007* (2013.01); *D21H 27/002* (2013.01)

(58) Field of Classification Search

CPC ..... D21C 9/001; D21C 9/002; D21C 9/004; D21C 9/005; D21C 9/007; D21H 11/16; D21H 11/20; D21H 27/00; D21H 27/002

USPC ..... 162/146, 157.1, 157.6, 70, 78, 87, 90; 536/56; 8/116.1

See application file for complete search history.

(56) References Cited

U.S. PATENT DOCUMENTS

| | | | |
|---|---|---|---|
| 4,444,621 | A | 4/1984 | Lindahl |
| 4,889,595 | A | 12/1989 | Herron et al. |

(Continued)

FOREIGN PATENT DOCUMENTS

| | | | |
|---|---|---|---|
| EP | 0209884 | A2 | 1/1987 |
| EP | 0210570 | A1 | 2/1987 |

(Continued)

OTHER PUBLICATIONS

International Search Report and Written Opinion, Apr. 26, 2011.

*Primary Examiner* — Eric Hug

(74) *Attorney, Agent, or Firm* — Harness, Dickey & Pierce

(57) ABSTRACT

The present invention relates to a process for producing an oxidized cellulose pulp fibrillar network and a composite with lignocellulosic fibers comprising the following steps: (a) oxidizing a cellulose pulp to obtain about 0.3 to 2.5 mmol carboxylic groups per gram cellulose pulp; and about 0.1 to 5.0 mmol aldehyde groups per gram cellulose pulp; (b) homogenization of the cellulose pulp of step (a) wherein the cellulose fibers are refined to provide a cellulose pulp comprising 0-50% of fibers having an average length 0.7 mm-2.1 mm; and 50-100% of fibers having a particle size of 0.05-500 micrometer (μm); and optionally (c) combining with lignocellulosic fiber. Also step (d) drying of the cellulose pulp obtained by step (b) or step (c) may be included in the process.

24 Claims, 8 Drawing Sheets

(56) References Cited

U.S. PATENT DOCUMENTS

| | | | | |
|---|---|---|---|---|
| 5,104,411 | A * | 4/1992 | Makoui et al. | 8/116.4 |
| 6,228,126 | B1 * | 5/2001 | Cimecioglu et al. | 8/108.1 |
| 6,379,494 | B1 * | 4/2002 | Jewell et al. | 162/9 |
| 6,540,876 | B1 * | 4/2003 | Cimecioglu et al. | 162/177 |
| 6,635,755 | B1 * | 10/2003 | Jaschinski et al. | 536/56 |
| 6,716,976 | B1 * | 4/2004 | Jetten et al. | 536/124 |
| 2002/0098317 | A1 * | 7/2002 | Jaschinski et al. | 428/72 |
| 2003/0024661 | A1 * | 2/2003 | Shore et al. | 162/9 |
| 2003/0073663 | A1 | 4/2003 | Wiseman et al. | |
| 2003/0230391 | A1 * | 12/2003 | Hamed et al. | 162/157.6 |
| 2004/0010137 | A1 | 1/2004 | Jaschinski et al. | |
| 2005/0028955 | A1 * | 2/2005 | Winslow | 162/129 |
| 2005/0028956 | A1 * | 2/2005 | Winslow | 162/129 |
| 2005/0061455 | A1 * | 3/2005 | Tan et al. | 162/9 |
| 2007/0119556 | A1 | 5/2007 | Tan et al. | |
| 2009/0054863 | A1 | 2/2009 | Tan et al. | |
| 2011/0198533 | A1 * | 8/2011 | Nachtkamp et al. | 252/182.12 |
| 2011/0262731 | A1 * | 10/2011 | Mukai et al. | 428/292.1 |

FOREIGN PATENT DOCUMENTS

| | | | |
|---|---|---|---|
| EP | 1149846 | A1 | 10/2001 |
| EP | 1325754 | A1 | 7/2003 |
| WO | WO-9507303 | A1 | 3/1995 |
| WO | WO-0050462 | A1 | 8/2000 |
| WO | WO-2006119392 | A1 | 11/2006 |
| WO | WO-2010071584 | A1 | 6/2010 |
| WO | WO 2010/131016 | * | 11/2010 |
| WO | WO 2011/088889 | * | 7/2011 |

* cited by examiner

PROCESS FOR PRODUCTION OF OXIDISED CELLULOSE PULP

TECHNICAL FIELD OF THE INVENTION

The present invention relates to a process for producing a homogenised oxidised cellulose pulp. The cellulose pulp can be further processed by a step of drying into a cellulosic absorbent product having a stable fibrillar network giving high absorption capacity. The process may also include a step wherein the cellulose pulp is combined with lignocellulosic fibres before the step of drying. The invention relates also to the cellulosic absorbent products and their use.

BACKGROUND ART

Absorbent materials are used in many different applications, for example in sanitary articles and in wound healing articles. The common requirement is high absorption capacity of the products. There are many different methods available for modifying and optimising the absorption property and capacity of the absorbent material. To this is also connected the property to retain the liquid after absorption, also when the product is put under pressure, which is an important aspect within some fields and applications.

Processes for producing products having a specified pore volume, giving an improved absorption capacity, are known from EP 0 209 884 A2 and EP 0 210 570 A1. These documents describe processes where pore generating particles are added during cross linking process of micro fibrillated cellulose for preparing absorbent retentive pulp. The processes require additional process steps for removing the pore generating particles.

U.S. Pat. No. 5,104,411 describes an absorbent product comprising a cross-linked and freeze dried microfibrillar pulp. The cellulose fibres, originating from, for example chemical wood pulp, are beaten and cross-linked before the step of freeze drying. The chemical pulp is not pre-treated by any oxidation.

US 2003/0073663 A1 describes a process for oxidation of cellulose derivatives, such as methyl cellulose, and ethyl cellulose. The oxidised cellulose derivates are to be used as bio absorbable medical devices. The oxidation is carried out by exposing the cellulose derivative to nitrogen oxide in an inert solvent such as carbon tetrachloride.

EP 1 325 754 A1 describes a wound dressing material comprising oxidised cellulose, wherein the oxidised cellulose is combined with structural protein and in form of sponge or film. The cellulose has preferably an average molecular weight greater than 50 000 and the oxidised cellulose is preferably oxidised regenerated cellulose (ORC).

WO 95/07303 describes a method for oxidising carbohydrates with high specificity, by using hypochlorite in the presence of nitroxyl compounds such as 2,2,6,6-tetramethylpiperidin-1-oxyl (Tempo). The oxidation is performed in an aqueous reaction medium at a pH of between 9 and 13. It is said that the process provided gives increased yield of oxidised carbohydrates, with less side-reactions.

Also EP 1 149 846 describes a process for oxidation of polysaccharides with hypochlorite in presence of, for example, 2,2,6,6-tetramethylpiperidine-1-oxyl. The oxidation process herein described is performed in absence of a bromide catalyst.

In T Saito, A Isogai, Biomacromolecules, 2004, 5, 1983-1989 a method to oxidise cellulose pulp originating from cotton linter with 2,2,6,6-tetramethylpiperidin-1-oxyl (Tempo) is described.

In T Saito, et al., Biomacromolecules, 2006, 5, 1689-1691 a method including oxidation of cellulose pulp originating from cotton linter with 2,2,6,6-tetramethylpiperidin-1-oxyl (Tempo) followed by a homogenisation is described.

In T Saito, et al., Biomacromolecules, 2007, 8, 2485-2491, a method for producing cellulose nanofibres by oxidation of native cellulose with 2,2,6,6-tetramethylpiperidin-1-oxyl (Tempo) is described. This is a method wherein cellulose nanofibres are formed by forcing formation of carboxylic groups under gentle treatment.

WO 2010/071584 describes composite material comprising superabsorbent material and cellulosic nanofibrils.

However, there is a need for cellulosic absorbent materials having high absorption capacity produced by efficient and economical processes, also without using additional components, such as pore generating agents, cross-linkers etc. There is also a demand of environmentally friendly processes.

The present invention fulfils the requirements and needs as are discussed above and provides a process for producing an adsorbent product.

SUMMARY OF THE INVENTION

The object of the invention is to provide a process for producing cellulosic absorbent material. Another object of the invention relates to the products obtained by the process.

The absorbent material can be used in a wide range of applications, such as incontinence articles and diapers; for wound care products, such as plaster, for absorption of bodily fluids from wounds, for example in form or plaster and bandage. Other areas for application of the products obtainable by the process of the invention, to utilise the hygroscopic properties, are as humidity absorbers and high-absorbing paper products, for example in electronic products, in packaging of humidity sensitive products etc. Further, absorption of liquids is important in many areas, for example in transportation and storage of food, such as fish and meat.

By the present invention a process is provided where a cellulose pulp is processed in following general steps:

(a) oxidation treatment;

(b) mechanical treatment/homogenisation; and optionally (c) combining with lignocellulosic fibres.

The process may optionally be followed by a drying step (d).

By the invention a process is provided where the cellulose pulp in the first step (step (a)) is treated by oxidation into a product where hydroxyl groups of the glucose units of the cellulose polymer are oxidised. The chemical characteristics are changed due to that the amount of aldehyde and carboxylic groups is changed, thus the hydroxyl groups substituted on the glucose units are transferred into aldehyde- and carboxylic acid groups. The presence of aldehyde groups is important in the process for obtaining the product obtained by the process as defined by step (a) to step (d). The aldehyde groups increase the stability of the stable fibrillar network by which a high absorption capacity is achieved due to large surface area as having a certain amount of carboxylic groups. The carboxylic groups participate in the absorption of the liquid as well as its retention in the product. The fibrillar network creates a product which is less prone to degradation and thus retains the large surface area.

The three-dimensional structure is obtained by the process as defined in step (a) to step (d).

More specifically, the process of the invention for producing an oxidised cellulose pulp fibrillar network comprises the following steps:

(a) oxidising a cellulose pulp to obtain at least 0.3 mmol carboxylic groups per gram cellulose pulp; and at least 0.1 mmol aldehyde groups per gram cellulose pulp; and (b) homogenisation, for example by mechanical treatment, of the cellulose pulp of step (a) wherein the cellulose fibres are refined to provide a cellulose pulp comprising 0-50% of fibres having a 'Kajaani fibre length' 0.7 mm-2.1 mm; and 50-100% of fibres having a 'Malvern particle size' of 0.05-500 micrometer.

'Kajaani fibre length' is herein referred to the average fibre length (length-weighted) of the sample measured with Kajaani FS300 equipment (using Tappi Standard T271) (further described in the section "Examples"). The 'Malvern particle size' is herein referred to the particle size measured with Malvern Mastersizer 2000 equipment (using default settings), which uses laser diffraction technique. Both methods were used to characterize the fibres as some parts of the material (the short fraction) was under the detection limit of the Kajaani FS300.

The process may further comprise an optional step, the step (c): adding of lignocellulosic fibres to the cellulose pulp fibrillar network provided by step (b).

The process may further comprise an optional step, the step (d): drying of the cellulose pulp fibrillar network provided by step (b) or step (c). The present invention relates also to the products obtained by the process of the invention, as well as to the products provided by the different steps of the process of the invention, thus from step (b), step (c) and step (d).

By the process of the invention a method to modify the cellulosic material to contain a large amount of aldehyde and carboxylic groups is provided. The new chemical composition results in an enhanced stability of the three-dimensional structure, for example of the porous foam. The process provides also a product having a high surface area (BET surface area). The product may also have high porosity. Thus the product has a large area accessible for liquid absorption, and also, the capillarity is improved which may provide a good retention of the liquid absorbed. By the process comprising step (c) a product having improved mechanical properties is achieved.

Hence, by the process of the invention products having improved absorbing, liquid spreading, liquid storage properties and mechanical properties, in comparison with products of untreated pulp, are obtained.

DETAILED DESCRIPTION OF PREFERRED EMBODIMENTS OF THE INVENTION

The present invention relates to a process for producing an oxidised cellulose pulp fibrillar network, cellulosic absorbent material, and cellulosic composite absorbent product (reinforced absorbent material). It also relates to the products obtained by the process, thus the cellulose pulp, the cellulosic absorbent material and the reinforced composite absorbent material.

The Starting Material for the Oxidation Process:

The cellulose suitable for the present invention is of any lignocelluloses material.

By the term 'cellulose pulp as starting material' it is herein meant the cellulose pulp as is introduced in step (a) of the process of the invention.

The cellulose pulp as starting material may be obtained by suitable treatment of softwood or hardwood. Softwood is for example, spruce fir, pine tree and larch. Generally, the softwood has an average fibre length of 1 to 5 millimeters, depending on types of wood. Hardwood is, for example, birch, beech, ash, aspen, and eucalyptus. Hardwood fibres have an average length of 0.5 to 3 millimeters.

The cellulose pulp as starting material may also be selected from recycled paper products, for example recycled paper pulp formed from mill broke, pre-consumer waste and post-consumer waste or mixed office waste. Other sources of cellulose pulp are annual plants like rice, bamboo, and bagasse.

The cellulose pulp as starting material can be selected from bleached or unbleached cellulose pulps. The cellulose pulps can be obtained by pulping according to, for example, but not limiting to, the sulphite method, the soda method, or the sulphate method. Further, bleaching of the cellulose pulp can be performed either by a chlorinated process or by a non-chlorinated process. For example, these processes can be classified as totally chlorine free (TCF), or elementary chlorine free (ECF). The cellulose pulp as starting material can be selected from pulps having been dried, or never dried, during the processing.

Preferably, the cellulose pulp as starting material for the process of the invention is bleached cellulose pulp.

The cellulose pulp as starting material has a content of cellulose of at least 60%, for example about 65, 70, 75, 80, 85 or 90%. Preferably, the cellulose pulp as starting material has a content of cellulose of about 70%.

Any commercially available cellulose pulp may be suitable for the process of the invention.

The cellulose pulp as starting material may be refined before it is introduced to the step of oxidation (defined as step (a)), for example by additional steps of mechanical treatment before the oxidation step (a). This may be advantageous when considering optimisation of energy demand of the process.

Also, steps like removal of impurities may be added to the process of the invention, for example before step (a). Another option is to remove impurities during the process of the invention, for example within or after step (a) or step (b).

The Oxidation Step (a):

The process of the invention includes a first step of oxidation (step (a)) of the glucose units. Cellulose is a linear polymer comprising repeating D-glucose units linked by β(1-4)-glycosidic bonds. The chemical structure of the cellulose molecule is shown by Formula I wherein n is normally up to 5000.

Formula I

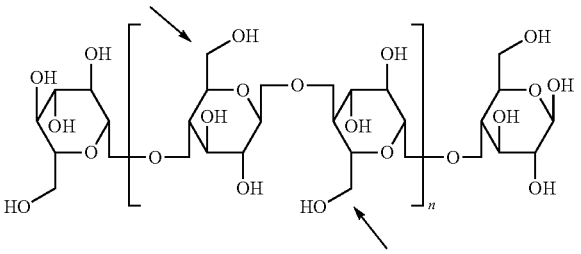

Preferably, the oxidation in the process of the invention is specific on the hydroxyl group positioned on the carbon-6 of the glucose units of the cellulose (marked by arrows).

The oxidation can be performed by addition of one or more suitable oxidising agent(s). The term oxidising agent is an agent which oxidise the hydroxyl groups on the glucose units of the cellulose chain. Oxidation of cellulose can be performed by any suitable process. Examples of oxidising agents are periodates, such as sodium periodat ($NaIO_4$), nitrogen oxides, $N_2O_4$, ozone, sodium hypochlorite, and hydrogen peroxide.

The concentration of the oxidising agent may be about 0.5 to 50 mmol/g cellulose pulp (oven dried). Preferably the concentration is about 1 to 30 mmol/g cellulose pulp (oven dried).

In another method the oxidation can be performed by free radical reaction. Such a process must be started by the introduction of an initiator. One option for the free radical reaction is to initiate the reaction with a catalytic agent generating free radicals. Another option to initiate the free radical reaction is by adding energy, for example by exposure of the reaction mixture with ultraviolet radiation, or by heating. The present invention is not limited to any of these oxidation methods. The oxidation results in an oxidised cellulose pulp.

By the term 'oxidised cellulose pulp' it is herein meant the cellulose pulp as is obtained in step (a) of the process of the invention, wherein the glucose units of the cellulose have been oxidised to certain degree.

The oxidising agent in a free radical reaction is a carrier of the free radical required for the oxidation process according to the present invention.

Examples of oxidising agents acting together with a catalytic agent are hypohalites and peroxides. The hypohalites are for example hypofluorites, hypochlorites, hypobromites, and hypoiodites. More specifically, the hypohalites may be selected from hypochlorites such as sodium hypochlorite (NaOCl), potassium hypochlorite (KOCl), lithium hypochlorite (LiOCl), or calcium hypochlorite ($Ca(OCl)_2$). The list of examples of oxidising agents is not exhaustive.

For the process according to step (a) the alkalimetal hypochlorite and the alkalimetal hypohalite may be based on the same alkalimetal, or different alkalimetals, selected from lithium, sodium and potassium. Sodium is the preferred alkalimetal for the oxidation process according to step (a).

The oxidation of the cellulose pulp according to step (a) is performed until at least 0.3 mmol carboxylic groups per gram cellulose pulp; and at least 0.1 mmol aldehyde groups per gram cellulose pulp are obtained.

Preferably, about 0.3 to 2.5 mmol carboxylic groups per gram cellulose pulp are obtained and about 0.1 to 5.0 mmol aldehyde groups per gram cellulose pulp are obtained during this process step. For example the cellulose pulp may have about 0.5 to 2.2 mmol carboxylic groups per gram cellulose pulp. For example, the cellulose may have about 0.2 mmol to 2.0 mmol aldehyde groups per gram cellulose pulp, another examples are about 0.2 mmol to 1.0 mmol aldehyde groups per gram cellulose pulp, and about 0.2 to 0.8 mmol aldehyde groups per gram cellulose pulp. It shall be understood that the carboxylic groups may be transformed into carboxylate groups, and vice versa, depending on the surrounding pH.

The oxidation of the cellulose pulp as in step (a) may be further defined by the following steps, when a free radical reaction is used for the oxidation:

1) providing a solution comprising an oxidising agent;

2) adding a cellulose pulp suspension;

3) adjusting the pH of the suspension obtained to pH between about 8 to 13 by adding an alkali agent; and 4) adding to the suspension a catalytic amount of a catalytic agent.

During the oxidation reaction the pH of the suspension may be adjusted to between about 8 to 13, for example between 8 and 10.5, by adding an alkali agent.

In the step of oxidation as defined above, thus the step (a), the different separate steps 1) to 4) may be performed either simultaneously; in any order; or sequentially step 1) to step 4). Another option is an oxidation reaction where two or more of steps 1) to 4) are combined and performed simultaneously.

In one embodiment of the invention the oxidising agent is selected from the group consisting of lithium hypochlorite (LiOCl), potassium hypochlorite (KOCl), sodium hypochlorite (NaOCl) and calcium hypochlorite ($Ca(OCl)_2$). The preferred oxidising agent is sodium hypochlorite.

The concentration of the oxidising agent is about 0.5 to 50 mmol/g cellulose pulp (oven dried). The oxidising agent is preferably added in an amount of at least 1 mmol of the oxidising agent per gram cellulose pulp. For example the concentration is about 1 to 30 mmol/g cellulose pulp (oven dried). Further examples are processes wherein the oxidising agent is present in an amount of about 1-10 mmol/g cellulose pulp, for example about 2-6 mmol/g cellulose pulp, such as 1, 1.5, 2, 2.5, 3, 3.5, 4, 4.5, 5, 5.5, 6, 6.5, 7, 7.5, 8, 8.5, 9, 9.5 or 10 mmol/g cellulose pulp (oven dried). These amounts are required for obtaining the amount of carboxylic groups and aldehyde groups creating the three dimensional structure giving high absorption capacity.

The content of carboxylic groups may be measured and determined by any known method, a non-limiting example is by sorption of methylene blue. This method is further described in P Fardim, B Holmbom, J Karhu, Nordic Pulp and Paper Research Journal, 2002, 17:3, 346-351, which is incorporated herein by reference.

A catalytic agent may be added to initiate and to catalyse the free radical reaction.

By the term 'catalytic agent' it is herein meant an agent which initiates and catalysis the free radical reaction.

One example of catalytic agents is peroxides. Another example is organic nitroxyl compounds, such as 2,2,6,6-tetramethylpiperidin-1-oxyl (Tempo), 2,2,5,5,-tetramethylpyrrolidine-N-oxyl (Proxyl), 4-hydroxy-2,2,6,6-tetramethylpiperidin-1-oxyl, and 4-acetamido-2,2,6,6-tetramethylpiperidin-1-oxyl, and derivatives thereof. These catalytic agents react with selectivity on carbon-6 of the glucose unit of the cellulose molecule. The organic nitroxyl compound 2,2,6,6-tetramethylpiperidin-1-oxyl (Tempo) is the preferred catalytic agent for the process of the invention. The 2,2,6,6-tetramethylpiperidin-1-oxyl (Tempo) shows stability during the reaction and can also be recovered and recycled from the process which is an important aspect from both economical and environmental perspectives.

The catalytic amount of the catalytic agent is about 0.005-5 mmol/g cellulose pulp (oven dried). Preferably the concentration of the catalytic agent is about 0.01-3 mmol/g cellulose pulp (oven dried).

In one embodiment of the invention the catalytic agent, when being an organic nitroxyl compound, is added in a catalytic amount, for example in an amount of 0.01-0.5 mmol/g cellulose pulp (oven dried), preferably between 0.05-0.2 mmol/g.

In one embodiment of the invention the catalytic agent is 2,2,6,6-tetramethylpiperidin-1-oxyl (Tempo).

In addition to the catalytic agent also a co-catalyst may be added. Examples of co-catalysts are alkali metal bromides and alkali earth metal bromides, for example sodium bromide (NaBr), potassium bromide (KBr), lithium bromide (LiBr), and calcium bromide ($Ca(Br)_2$). The alkali metal bromide or alkali earth metal bromide reacts with the alkali metal hypochlorite to form alkali metal hypobromite or alkali earth metal hypobromite, respectively, during the reaction. By the presence of this co-catalyst a higher yield may be expected as the amount of side reactions may be reduced.

The co-catalyst is preferably added to step 1). The concentration of the co-catalyst may be 0.005-50 mmol/g cellulose pulp (oven dried); for example 0.5-20 mmol/g; and a further example 0.2-10 mmol/g. The preferred co-catalyst is sodium bromide (NaBr).

In one embodiment of the oxidation reaction the oxidising agent sodium hypochlorite (NaOCl), the catalytic agent 2,2,6,6-tetramethylpiperidin-1-oxyl (Tempo), and the co-catalytic agent sodium bromide (NaBr) the components may be added in the following amounts:

a) oxidising agent NaOCl in an amount of: 1 to 10 mmol/g;

b) catalytic agent 2,2,6,6-tetramethylpiperidin-1-oxyl (Tempo) in an amount of: 0.01-0.50 mmol/g; and c) co-catalytic agent NaBr in an amount of: 0.2-10 mmol/g.

Preferably, the components are present in the following amounts:

a) oxidising agent NaOCl in an amount of: 2-6 mmol/g;

b) catalytic agent 2,2,6,6-tetramethylpiperidin-1-oxyl (Tempo) in an amount of: 0.05-0.2 mmol/g; and c) co-catalytic agent NaBr in an amount of: 0.7-3 mmol/g.

At the start of the process according to step (a) the cellulose pulp shall have a pH of between about 8 and 13, for example between 8.5 and 10.5. This pH range is then, preferably kept during the whole oxidation process. This pH range has been found to be the most efficient and economical for the oxidation reaction. The oxidation treatment of the pulp is preferably performed at pH between about 8 and 11, for example between about 8.5 and 10.5. Other examples are, at pH 8, 8.5, 9, 9.5, 10, 10.5, 11, 11.5, 12, 12.5 and 13. The pH can be kept in a range of pH between about 9 toll, for example between 9.75 and 10.25.

The alkali agents are preferably added continuously but may also be added intermittently during the process.

By the term 'alkali agent' is meant alkaline compounds like hydroxides and carbonates, such as alkali metal hydroxides and alkali metal carbonates. The alkali agent may optionally be selected from the group comprising lithium hydroxide (LiOH), potassium hydroxide (KOH), sodium hydroxide (NaOH), calcium hydroxide ($Ca(OH)_2$), lithium carbonate ($Li_2CO_3$), potassium carbonate ($K_2CO_3$)), sodium carbonate ($Na_2CO_3$) and calcium carbonate ($CaCO_3$).

In the process of the invention the oxidation treatment according to step (a) is performed at a temperature of between 5 and 160° C., for example, between 10 and 95° C., between 10 and 70° C., such as between 15 and 60° C. Further examples of suitable reaction temperature are about 15, 20 (i.e. room temperature), 25, 30, 35, 40, 45, 50, 55, and 60° C. When the temperature is about 100° C. or above, the reaction shall be performed at increased pressure in suitable equipment. Temperature selected during the process of the invention may depend on application and use of the final product. At higher temperature, inter alia, at temperature above 150° C., there is a potential risk for discoloration of the cellulose pulp. Avoidance of discoloration of the product may be an important aspect from an aesthetical perspective when the product is to be used in, for example, health care or sanitary products where the appearance and cleanness is important for the customer.

In connection to the step of oxidation also one or several additional steps of separating the cellulose pulp from the liquid system forming the suspension as obtained after step (a); and washing. The separation, and subsequent washing, of the solid material from the liquid may be performed by any processes known in the art, such as filtration in any filtration equipment, gravitational separation methods such as centrifugation; cross-flow filtration (tangential flow filtration). Other examples are membrane filtration, and nano-filtration. The list of methods is not exhaustive. The liquid system which has been separated from the oxidised cellulose pulp may, with advantage, be re-circulated. By that, the components, like the catalytic agents, co-catalysts, residual oxidising agents etc, are also recycled or re-circulated and can be re-used in the process. Hence, the process of the invention may comprise an additional step wherein the liquid system, comprising the catalytic agent, co-catalyst and oxidising agent, is re-circulated to step (a).

Optionally, before entrance to the following step (b) a portion of the liquid system may be added to the oxidised cellulose pulp to create a suitable viscosity of the suspension. The viscosity depends on the apparatus used and is well-known to the skilled person.

The Homogenisation Step (b):

The pulp obtained after the oxidation as described above is further processed by homogenisation. During the oxidation reaction the fibres in the cellulose pulp are chemically treated, and products having certain amounts of carboxylic acid-, and aldehyde-groups are obtained. By the following homogenisation the cellulose is mechanical treated to provide a cellulose product fibrillar network having a certain structure.

By the term 'oxidised cellulose pulp fibrillar network' it is herein meant the cellulose pulp as is obtained in step (b).

The homogenisation of the cellulose pulp of step (a) is performed until the cellulose fibres are refined into a cellulose pulp comprising 0-50% of fibres having an average 'Kajaani-length' of 0.5 mm-2.5 mm, and 50-100% of fibres having a 'Malvern particle size' of 0.05-500 micrometer. The size of the fibres may be measured by different methods and equipments.

Preferably, the homogenisation of the cellulose pulp of step (a) is performed until the cellulose fibres are refined into a cellulose pulp comprising 1-50% of fibres having a 'Kajaani fibre length' of 0.5 mm-2.5 mm, and 50-99% of fibres having a 'Malvern particle size' of 0.05-500 micrometer.

Preferably, the homogenisation is performed until the cellulose pulp comprises 0-50%, preferably 1-50%, of fibres having a 'Kajaani fibre length' of 0.7 mm-2.1 mm and 50-100%, preferably 50-99%, of fibres having a 'Malvern particle size' of 0.05-500 micrometer.

In the step of homogenisation the oxidised pulp is suspended together with a liquid system to a mixture having a solid content of 0.1-30% by weight, for example 0.2-20% by weight, or 0.3-15% by weight, or 0.4-10% by weight.

During the homogenisation of the oxidised cellulose pulp wherein the fibres of the cellulose pulp are disintegrated into finer structures and partly the fibrils of the cellulose pulp are liberated. The homogenisation may be performed by mechanical treatment in an apparatus giving enough energy input by shearing and/or impact forces to refine or disintegrate the cellulose fibres and fibrils. The cellulose pulp obtained from step (a) can be homogenised by any known method wherein forces are applied to a cellulose pulp for refining the fibres, for example the cellulose pulp can be crushed or be exposed to high pressure by other means. The method and apparatus for the homogenisation are not critical for the process of the invention, provided that a sufficient degree of refining into the cellulose fibrils, i.e. disintegration of the oxidised fibres, is accomplished. There are commercial available high shear dispersers. The critical factor for the apparatus to be used may be the shearing and/or impact forces as are exerted on the oxidised pulp, an oxidised cellulose fibrillar network will be obtained. The mechanical energy required for refining the cellulose pulp is less than 10 kWh/kg, for example less than 5 kWh/kg, or less than 2 kWh/kg.

The required energy input depends mainly on the cellulose pulp as starting material and the degree of oxidation achieved during the oxidation step (step (a)), but also on the efficiency of the specific equipment used. In general, the requirement of energy input is less if higher degree of oxidation is applied.

Depending on the starting material, the conditions during the oxidation step, and the requirement and purpose of the final product the mechanical treatment achieved during the oxidising step can be enough for liberating the cellulose fibrils. Also the mechanical treatment obtained by the apparatus and transport systems (including pumps etc) connected to the process may provide enough mechanical treatment.

In one embodiment of the invention the process for producing an oxidised cellulose pulp or cellulosic absorbent product comprises the following steps:

(a) oxidising a fibre like cellulose pulp to obtain about 0.3 to 2.5 mmol carboxylic groups per gram cellulose pulp; and about 0.1 to 5.0 mmol aldehyde groups per gram cellulose pulp;

(b) homogenisation by mechanical treatment of the cellulose pulp of step (a) wherein the cellulose fibres are disintegrated to provide a cellulose pulp comprising 0-50%, preferably 1-50%, of fibres having a 'Kajaani fibre length' of 0.7 mm-2.1 mm, and 50-100%, preferably 50-99%, of fibres having a 'Malvern particle size' of 0.05-500 micrometer; and optionally, drying (defined as step (d) above) of the cellulose pulp provided by step (b).

In one embodiment of the invention the process for producing a cellulosic composite pulp or cellulosic composite absorbent product comprises the following steps:

(a) oxidising a fibre like cellulose pulp to obtain about 0.3 to 2.5 mmol carboxylic groups per gram cellulose pulp; and about 0.1 to 5.0 mmol aldehyde groups per gram cellulose pulp;

(b) homogenisation by mechanical treatment of the cellulose pulp of step (a) wherein the cellulose fibres are disintegrated to provide a cellulose pulp comprising 0-50%, preferably 1-50%, of fibres having a 'Kajaani fibre length' of 0.7 mm-2.1 mm, and 50-100%, preferably 50-99%, of fibres having a 'Malvern particle size' of 0.05-500 micrometer;

(c) combining with lignocellulosic fibre; and optionally (d) drying of the cellulose pulp provided by step (c).

In one embodiment of the invention an oxidised cellulose pulp fibrillar network obtainable by the process as defined in step (a) and step (b) as above is provided.

By the process of the invention is an oxidised cellulose pulp fibrillar network suspension wherein the cellulose pulp comprises about 0.3 to 2.5 mmol carboxylic groups per gram cellulose pulp; and about 0.1 to 5.0 mmol aldehyde groups per gram cellulose pulp; and wherein the cellulose pulp comprises 0-50% of fibres having a 'Kajaani fibre length' of 0.7 mm-2.1 mm, and 50-100% of fibres having a 'Malvern particle size' of 0.05-500 micrometer provided.

In one embodiment of the invention an oxidised cellulose pulp fibrillar network is provided wherein at least 50% of the cellulose pulp is of short fraction (and that 50% of this fraction has a 'Malvern particle size' of less than 120 μm; and 90% of the fraction has a 'Malvern particle size' particle size of less than 400 μm.

In one embodiment of the invention an oxidised cellulose pulp is provided wherein at least 70% of the cellulose pulp is of short fraction and that 50% of this fraction has a 'Malvern particle size' of less than 120 μm; and 90% of the fraction has a 'Malvern particle size' of less than 350 μm.

In one embodiment of the invention the process for producing an oxidised cellulose pulp fibrillar network comprises the following steps:

(a) oxidising a cellulose pulp with an oxidising agent to obtain about 0.3 to 2.5 mmol carboxylic groups per gram cellulose pulp; and about 0.1 to 5.0 mmol aldehyde groups per gram cellulose pulp; by 1) providing a solution comprising an oxidising agent; and optionally a co-catalyst;
2) adding a cellulose pulp suspension;
3) adjusting the pH of the suspension obtained to pH between about 8 to 13 by adding an alkali agent; and
4) adding to the suspension a catalytic amount of a catalytic agent; and (b) homogenisation of the cellulose pulp of step (a) wherein the cellulose fibres are refined to provide a cellulose pulp comprising 0-50% of fibres having a 'Kajaani fibre length' of 0.7 mm-2.1 mm; and 50-100% of fibres having a 'Malvern particle size' of 0.05-500 micrometer.

In one embodiment of the invention lignocellulosic fibres are added to the cellulose suspension obtained after the homogenisation. The lignocellulosic fibres may be produced and prepared by known processes before it is combined. The fibres may, for example, be a product of a thermomechanical (TMP) pulping process, chemi-thermomechanical (CTMP) pulping, high temperature chemithermomechanical (HTCTMP) pulping and chemical pulping process, or a mixture thereof. Also chemically modified lignocellulosic fibres may be included in the process of the invention.

The properties of the cellulosic composite absorbent product may depend on the lignocellulosic fibre selected. A cellulosic composite absorbent product comprising lignocellulose fibres obtained from, for example a chemi-thermomechancial pulping process shows higher stiffness than a product comprising a chemically modified lignocellulosic fibre which gives a more elastic product.

The cellulosic composite product according to the invention comprises 50 to 95 weight-% fibres, preferably between 70-90 weight-%. The amount of fibre in the cellulosic absorbent is an important parameter to consider from an economical point of view, and therefore it may be important to optimize the process regarding the fibre content and still achieve the desired absorption capacity.

Before adding the lignocellulosic fibres to the cellulose suspension the fibres may be dry defibrated alternatively wet defibrated fibres which then has been washed with solvent which easily evaporates. Preferably, the lignocellulosic fibres to be added are substantially water-free, thus have more than 30% dry content.

The Liquid System:

The cellulose pulp comprises a 'liquid system' which is herein defined as a water based system comprising at least 50% by volume of water.

The liquid system may in addition to the water also contain polar solvents such as alcohols, ketones. Examples of suitable polar solvents are lower alcohols like methanol ($CH_3OH$), ethanol ($CH_3CH_2OH$) and isopropanol $(CH_3)_2CHOH$; and ketones like acetone ($CH_3COCH_3$). The list of polar solvents suitable to be mixed with water in the liquid system is not exhaustive. The liquid system may comprise 50, 55, 60, 65, 70, 75, 80, 85, 90, 95, 96, 97, 98, 99, or 100 v/v % water and 0, 1, 2, 3, 4, 5, 10, 15, 20, 25, 30, 35, 40, 45, 50 v/v % of polar solvent.

The liquid system may be selected to be of the same composition during the whole process, during the oxidation step as well as the homogenisation step. However, in a process including an oxidation process comprising 2,2,6,6-tetramethylpiperidin-1-oxyl it is preferred to select a liquid system not including any alcohol during the oxidation step, for example water is the preferred liquid system. If the liquid system is to be selected to contain the same components during the whole chain of reaction steps, thus to be used both during the oxidation step (step (a)) and during the homogenisation (step (b)) it is preferred to avoid alcohols as the alcohol then also is to be oxidised during the step (a), the oxidation.

Preferably, the liquid system during the oxidation of the cellulose pulp, thus during the step (a) comprises 100% water. Then, the liquid system added after the step of dewatering and washing may comprise water and an amount of the polar solvent. It might be an advantage to add a specific amount of polar solvent during the homogenisation as the viscosity of the suspension can be modified which results in that less energy input is required for the process. Also other components like surfactants can be added. Also, the energy input required during the drying process, thus in step (c), may be optimised by selecting suitable components in the liquid system.

The Drying Step (d):

The cellulose pulp fibrillar network obtained after the step of homogenisation may be dried in numerous ways, non-limiting examples of drying methods are freeze drying, spray drying, air- or gas drying, steam drying.

The form of the product obtained after the step of drying (step (d)), obtainable by the process of the invention is dependent on how the drying in step (d) is performed.

In one embodiment of the invention is a cellulosic absorbent product comprising the oxidised cellulose pulp obtainable by the process as defined in step (a) to step (d) as above provided.

Freeze drying can be performed by freezing of the pulp obtained after step (a) alternatively after step (b), or after step (c). The frozen liquid system is sublimated directly from the frozen state of the pulp. Any commercially available method may be used. One example of freezing is by liquid nitrogen, another is indirect cooling by using an external cooling medium. The material obtained after the freeze drying may be very porous and sponge like, and may have a structure which range from a quite ordinary fibre network to a non transparent foam.

In one embodiment of the process of the invention the drying step (d) is performed by freeze drying.

In one embodiment a cellulosic absorbent product is provided being a fibrillar network characterized in having a surface area (BET surface area) of at least 25 $m^2/g$, and a total pore volume of between 5-500 $cm^3/g$. Preferably the surface area is of at least 30 $m^2/g$. Preferably, the total pore volume is of between 10-200 $cm^3/g$, for example between 20-100 $cm^3/g$.

In one embodiment a cellulosic absorbent product is provided being a freeze dried fibrillar network characterized in having a surface area (BET surface area) of at least 25 $m^2/g$, and a total pore volume of between 5-500 $cm^3/g$. Preferably the surface area is of at least 30 $m^2/g$. Preferably, the total pore volume is of between 10-200 $cm^3/g$, for example between 20-100 $cm^3/g$.

By the term 'surface area' and 'BET surface area' it is meant a measure of the accessible area of the cellulosic absorbent product. This is a way of quantifying the total amount of solid surface provided by the cellulosic absorbent material. A method to measure the BET surface area is further described in P A Webb and C Orr, Analytical Methods in Fine Particle Technology, 1st ed. Norcross: Micrometrics Instrument Corporation, 1997, and is herein incorporated by reference.

Other options for drying the cellulose pulp are by air- or gas drying. This drying process can be performed by any known air- or gas drying methods and apparatus. The air- or gas drying of the cellulose pulp may be conducted at elevated or atmospheric pressure. Examples of air- and gas drying processes are spray drying, fluid bed drying, rotary drier, tunnel air drier, and conveyor drier. In these methods common air can be used, or alternative, a gas. Examples of suitable gases for drying the cellulose pulp are nitrogen gas, flue gas, and superheated steam. The process of air- or gas-drying can be performed in room temperature, or be forced by an elevated temperature of for example 30, 50 or 70° C. The air- or gas drying may also be performed at temperatures of up to 105° C., or even up to 180° C.

The air- or gas drying is preferably performed after step (b) or after step (c).

In one embodiment of the process of the invention the drying step (d) is performed by air- or gas drying.

In one embodiment a cellulosic absorbent product is provided being a fibrillar network characterized in having a surface area (BET surface area) of 0.1 to 2.0 $m^2/g$, preferably of 0.1 to 2.0 $m^2/g$, and a water absorption capacity of at least 15 g/g. Preferably, the surface area (BET surface area) is of 0.2 to 0.8 $m^2/g$.

In one embodiment a cellulosic absorbent product is provided being an air dried fibrillar network characterized in having a surface area (BET surface area) of 0.1 to 2.0 $m^2/g$, preferably of 0.1 to 2.0 $m^2/g$, and a water absorption capacity of at least 15 g/g. Preferably, the surface area (BET surface area) is of 0.2 to 0.8 $m^2/g$.

The present invention provides possibilities to provide a range of cellulosic absorbent products with different properties, but with a high absorption capacity in common. By combining the specific parameters for the treatment of the cellulose pulp by the oxidation with the parameters for the homogenisation, the ratio of short fibres and long fibres of the cellulose fibres, the properties can be changed. It is possible to determine the structure of the foam by careful selection of parameters such as level of oxidation in step (a) and the level of homogenisation in step (b). Depending on the drying process of step (d) there are possibilities to provide absorbent products in form of, for example, porous foam, compressed porous foam, granules, pressed granules, thin film, powder, and porous sandwich structure.

For example, an absorbent material in form of film can be obtained by air drying of the pulp of step (b). This film may be a thin semitransparent film of absorbent material when the pulp is poured on a suitable mean, such as a plate, and air dried at room temperature and at atmospheric pressure. The transparency of the obtained product can vary depending on the starting material, the degree of oxidation, the mechanical treatment and the final drying process. This is further described by the Examples.

A cellulosic absorbent product in form of a foam or sponge may be obtained by a freeze drying method.

The aldehyde and carboxylic groups imparted to the cellulosic pulp according to step (a) remain even after the pulp has been subjected to the homogenisation according to step (b), after the optional step (c) wherein the lignocellulosic fibre is included and the drying according to step (d).

The aldehyde groups generated by the process according to step (a), thus the oxidation, serve to enhance to stability of the material by forming covalent bonds within and between the cellulose polymers (inter- and intrafibrillar), thus cross-links are formed within the fibrillar network. These strong bonds are important for preservation of the three-dimensional structure as are obtained by the drying step (step (d)) and gives an improved mechanical strength of the product which is an important aspect for some applications of the cellulosic absorbent product. For example, the three-dimensional structure obtained after freeze drying is less prone to degradation.

The Cellulosic Composite Absorbent Product

A cellulosic composite absorbent product comprising the mixture of lignocellulosic fibres and cellulosic absorbent product, for example in form of a foam or sponge, may be obtained by drying the mixture/dispersion obtained in step (c).

In one embodiment of the invention a cellulosic composite absorbent product is provide which comprises: an oxidised cellulose pulp fibrillar network, wherein the cellulose pulp comprises about 0.3 to 2.5 mmol carboxylic groups per gram cellulose pulp; and about 0.1 to 5.0 mmol aldehyde groups per gram cellulose pulp; and wherein the cellulose pulp comprises 0-50% of fibres having a 'Kajaani fibre length' of 0.7 mm-2.1 mm; and 50-100% of fibres having a 'Malvern particle size' of 0.05-500 micrometer (μm); and lignocellulosic fibres having a fibre length of at least 0.5 mm.

The cellulose composite absorbent product comprises lignocellulosic fibre in an amount of 50-90%, preferably in an amount of 70-90%, of total weight cellulose composite absorbent product.

Comment: An additional white scalebar (same length as the original scalebar) was added to FIGS. 1, 2, 3, 4*a*, 4*b* and 4*c*. It has been placed so that both scalebars (original grey and new white) are visible in these figures.

Figure 5A:
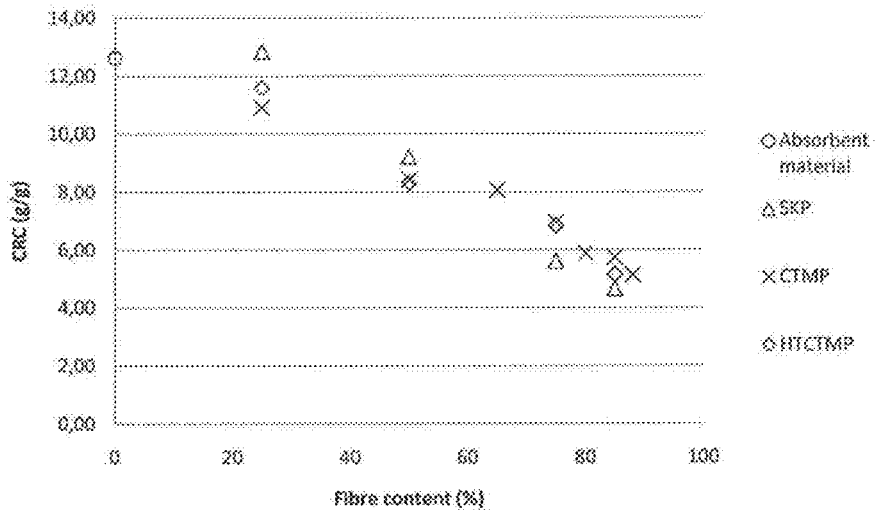

FIG. 5*a*—FIG. 5*a* illustrates the centrifuge retention capacity of the composite absorbent material versus the content of fibres in the composite absorbent material.

Figure 5B:
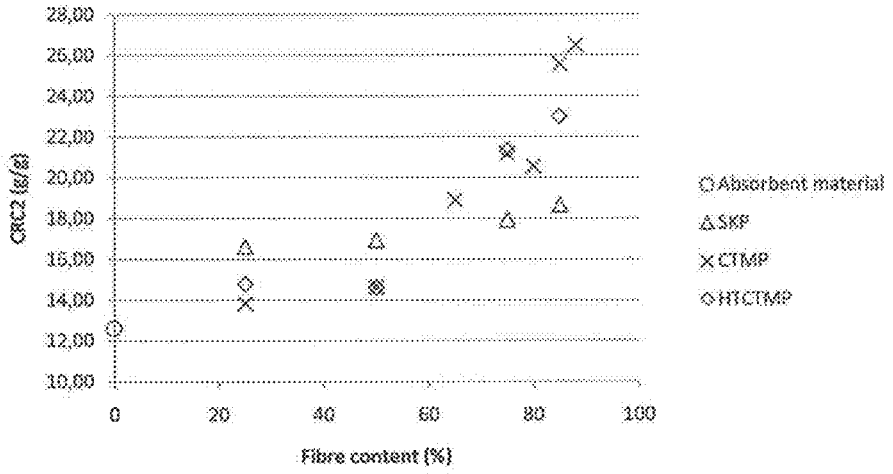

FIG. 5*b*—FIG. 5*b* illustrates the centrifuge retention capacity of absorbent material when it has been combined with fibres in a composite absorbent material versus the fibre content.

Figure 6:
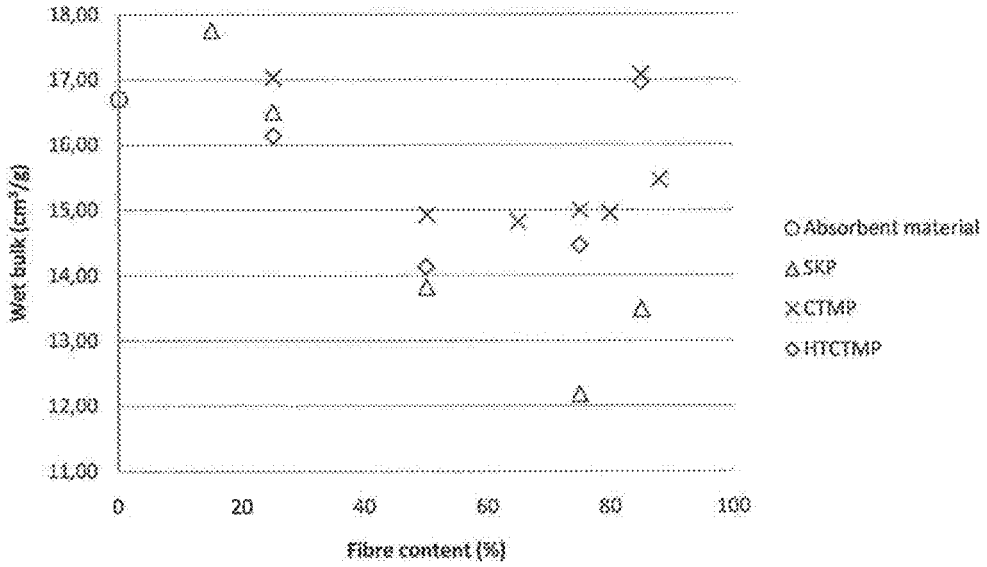

FIG. 6—FIG. 6 illustrates the wet bulk (at 5.2 kPa) of the composite absorbent material versus the content of fibres in the composite absorbent material.

The following examples indicate various possible methods for making and using the oxidised cellulose pulp of the present invention. The examples are only illustrative, and are not construed as limiting the present invention to any particular compounds, processes, or conditions.

EXAMPLES

The invention is further shown by the following examples.

The source and quality grade of the chemical components, added according to the Examples, for the process is listed in Table 1. The charge of chemicals in the examples is written as charge of theoretically pure chemicals. Therefore the actual charge must be calculated to compensate for the impurities in the different chemicals. The available chlorine in the sodium hypochlorite solution was determined before each oxidation experiment.

TABLE 1

List of chemical components

| Chemical name | Source | Purity |
|---|---|---|
| Sodium chlorite | SIGMA-ALDRICH | Technical grade, 80% |
| Sodium hypochlorite (solution) | SIGMA-ALDRICH | Reagent grade, available chlorine 10-15% |
| TEMPO (2,2,6,6-tetramethylpiperidinyl-1-oxyl) free radical | SIGMA-ALDRICH | 98% |
| Sodium bromide | Scharlau | Reagent grade, 99.5% |
| Methylene blue | Scharlau | Extra pure |
| Di-sodium phosphate-12-hydrate | MERCK | min. 99% |
| Mono-sodium phosphate Mono-hydrate | MERCK | min. 99% |
| Acetic acid (solution) | Scharlau | min. 99.7% |
| Sodium hydroxide | Fischer Scientific | min. 99% |
| Sodium chloride | Scharlau | min. 99.5% |
| Sodium borohydride | Alfa Aesar | 98% |
| Hydrochloric acid (solution) | Scharlau | 37-38% |
| Acetone | MERCK | 99.8% |

Examples 1-4

Oxidation of the Cellulose Pulp as Starting Material

A solution (1.20 L) containing 0.1 mM 2,2,6,6-Tetramethylpiperidin-1-oxyl, free radical (Tempo) and 1 mM NaBr (sodium bromide) was prepared. 12.0 g (oven dried (o.d.)) of the cellulose pulp as starting material was added to the solution. After the pulp was added the suspension was adjusted to pH 10 with 1M NaOH.

The free radical reaction was started by adding a certain amount of sodium hypochlorite solution (NaOCl) solution (defined in table below) and adjusted to pH 10. The free radical reaction was carried out at room temperature (20° C.). The suspension was continuously stirred using a magnetic stirrer. The pH was maintained between 9.75 and 10.25 during the reaction by adding 1M NaOH drop wise. The reaction was stopped then no further decrease in pH was observed. The reaction time was longer with high dosage of NaOCl, with a maximum of 150 min at 5 mmol NaOCl/g cellulose pulp.

After the reaction, the pulp suspension was placed in a Büchner funnel with a nylon web (length between wires: 200 μm, diameter of wires: 400 μm) and the liquid was separated from the oxidized pulp. The separation was repeated once by returning the filtrate. The oxidised cellulose pulp was then washed with deionized water, at least 0.4 L per gram of oxidised cellulose pulp.

| Example: | Starting material | Concentration of NaOCl (mmol/g pulp (oven dried)) |
|---|---|---|
| 1 | Bleached softwood sulphate pulp, TCF, never dried | 1 |
| 2 | Bleached softwood sulphate pulp, TCF, never dried, | 2.5 |
| 3 | Bleached softwood sulphate pulp, TCF, never dried | 3.8 |
| 4 | Bleached softwood sulphate pulp, TCF, never dried | 5 |

By adding different amounts of NaOCl according to Examples 1 to 4 above, cellulose pulps with different content of aldehyde- and carboxylic-groups were obtained.

Determination of the Content of Carboxylic Groups by Sorption of Methylene Blue

The content of carboxylic groups for the different pulps according to Examples 1 to 4 was analysed. The measurements were conducted with sorption of methylene blue. 0.05 g (oven dried). The cellulose pulps according to Examples 1 to 4 were added to a beaker with 100 mL 0.01 HCl. The suspension was stirred for 1 h with a magnetic stirrer. After that, the pulp was washed with HCl (50 mL, 0.01M) and deionised water. The water in the sample was carefully dewatered, before the sample was added to a beaker together with 100 mL of buffer containing methylene blue (0.002M $NaH_2PO_4$, 0.0078M $Na_2HPO_4$ (buffer adjusted to pH 7.8), 0.4798 g methylene blue, and deionised water to a total volume of 1.00 L).

The sorption time was 1 h and conducted in darkness. The reaction mix was then filtered and the filtrate was diluted 125 times its original volume and analyzed on a spectrophotometer (Hitachi U-3200). The absorbance was measured at 664 nm and the absorbance adjusted by dilution so that the absorbance was between 0.2-0.8. The fibres were collected on a filter paper and were then washed with 200 mL of 0.01M HCl to desorb the methylene blue from the fibres. The fibres were further washed with deionised water, dried in an oven at 105° C. for at least 4 hours, and then the weight of the fibres were measured. The amount of carboxylic groups were calculated based on the consumption of methylene blue and the fibre weight. The method is further described in P Fardim, B Holmbom, J Karhu, Nordic Pulp and Paper Research Journal, 2002, 17:3, 346-351, which is incorporated by reference.

The Result of the Measurement of the Content of Carboxylic Groups (mmol/g):

Reference example I: Bleached softwood cellulose pulp 0.07

Example 1: 0.42

Example 2: 0.92

Example 3: 1.02

Example 4: 1.38

Determination of the Content of Aldehyde Groups:

An oxidation with sodium chlorite was performed to determine the content of aldehyde groups in the pulp. The sodium chlorite oxidises the aldehyde groups in this slow reaction. The content of aldehyde groups is then calculated by the increase in the content of carboxylic groups compared with a sample not oxidised with sodium chlorite. 0.05 g of cellulose pulp sample was added to a mixture of 10 mL of 0.5M $CH_3COOH$, 5 mL of 0.5M NaOH, 0.04 g of $NaClO_2$ and 85 mL of deionized water. The pH of the solution was 4.6. The cellulose pulp suspension was stirred during the 24 h reaction time. After the reaction the pulp was washed with 200 mL of deionized water. The content of carboxylic groups was then determined by the method with sorption of methylene blue, see above.

Reduction of Aldehyde Groups by Treatment with Borohydride 5 g of oxidised cellulose pulp according to Example 4 was suspended in water, solid content 8%, together with 0.303 g sodium borohydride ($NaBH_4$) and 0.115 g 0.05 mM NaOH. The suspension was poured into a plastic bag and the plastic bag was put in a water bath (60° C.) for 2 hours. During the reaction carbonyl groups was reduced to hydroxyl groups. After the reaction time was ended the cellulose pulp was cooled by dilution with cold water and then the sample was dewatered and washed with deionized water.

The original bleached softwood sulphate pulp contained 0.03 mmol aldehyde groups/g cellulose pulp. By the tempo oxidation treatment according to Example 4 the content of aldehyde groups were increased to 0.61 mmol/g cellulose. By reduction with sodium borohydride this content were decreased to 0.14 mmol/g.

Examples 5-8

The Homogenisation, by Mechanical Treatment of the Oxidised Pulp

The pulps obtained from the above Examples 1 to 4 were further treated by mechanical treatment as follows.

5.0 g of the free radical oxidised pulps prepared in Examples 1 to 4 were suspended with water to a suspension having solid content of 1%.

The pulp was homogenised, the fibres in the pulp was disintegrated into finer structures by a high shear laboratory batch mixer (Ultra-Turrax T 45/N (IKA WERK)) speed: 10 000 rpm, rotor diameter: 40 mm, stator diameter: 45 mm.

Samples were collected after 1, 3, 5, 10 and 15 minutes and the solid content of them were tested and presented as Example 5 to 8 in Table 2. All durations of mechanical treatment in the examples in this document are based on 5 g of solid material.

TABLE 2

| | Solid content (% by weight) | | | | |
|---|---|---|---|---|---|
| | 1 min | 3 min | 5 min | 10 min | 15 min |
| Example 5 | — | — | 1 | 1 | 1 |
| Example 6 | — | — | 1 | 1 | 1 |
| Example 7 | 1 | 1 | 1 | 2/3 | — |
| Example 8 | 1 | 2/3 | 2/3 | 2/3 | 1/2 |

As the homogenisation of the material progresses, the viscosity of the suspension increases. In Examples 7 and 8 the suspensions became too viscous so that dead zones were created in the sample beaker. To provide a good mixing of the entire volume of these samples, they were diluted with a portion of deionised water, as defined in Table 2, to enable further treatment.

Example 9

3.0 g (o.d) of the oxidized pulp, prepared according to example 4, was suspended with deionised water to a solid content of 0.6%. The pulp was homogenised, the fibres in the pulp was disintegrated into finer structures by a high shear laboratory batch mixer (Ultra-Turrax T 45/N (IKA)) speed: 10 000 rpm, rotor diameter: 40 mm, stator diameter: 45 mm. After 9 minutes the homogenisation/grinding was stopped and the gel-like product was stored in a plastic bag at 4° C.

Total pore volume (calculated): 170 $cm^3/g$ (calculated according formula presented in Example 11).

Characterisation:

To characterize the effect of the homogenisation treatment a fractionation of the sample were performed that divided the material in the sample into two fractions. Kajaani fibre length was measured for both these fractions and Malvern particle size was measured for the short fraction. The reason for the particle size measurement was to quantify the size of element that was under the detection limit of the fibre analyzer.

Fractionation—Long and Short Fraction:

Fractionation of long and short fibres was conducted in order to show the relative ease of refining of the fibres.

10 g of the homogenised oxidised cellulose pulp according to Examples 5 to 8 having a concentration between 0.5-1% by weight cellulose pulp, was added to a beaker.

80 ml of deionized water and 10 ml of 0.1M HCl was subsequently added. The suspension was then gently stirred with a magnetic stirrer for 1 h. The addition of acid protonized the carboxylic acid groups, which facilitated the liberation of the individual fibre fragments into the suspension. Prior to the actual fibre fractionation, the pH was set to 7 by adding 0.5M NaOH dropwise.

To decide the amount of long fibres remaining after the mechanical treatment step, long and average long fibres (long fraction) were separated from short fibres (short fraction) by a Dynamic Drainage Jar. The Dynamic Drainage Jar, manufactured by Paper Research Materials, consists of a vessel with a stirring device, a metallic screen with conical holes (metallic screen 40M was used which is about equivalent to an ordinary quadratic 50 Mesh net) and plastic tube in the bottom to collect the filtrate (no bottom glass cone were used).

The ion exchanged sample was diluted with a total volume of approximately 500 mL using deionised water. The diluted sample was added to the drainage vessel (bottom tube closed) and stirring was started for 15 seconds at 1500 rpm (revolutions per minute). After that the stirring speed was adjusted to 750 rpm and the bottom tube was opened so the water and the short fraction could be drained into a beaker. After the drainage, the short fraction and the long fraction were collected and both were diluted to a total weight of each suspension of 500 g. The solid contents of the suspensions were determined isolation of the solid material by filtration followed by weighing after drying at 105° C. for four hours.

Measurements were also conducted to determine fibre length (herein denoted 'Kajaani fibre length') of the long fraction and the short fraction. Kajaani fibre length refers to the average fibre length (length-weighted) of the sample measured with Kajaani FS300 equipment (using Tappi Standard T271). The sample amount varied between 25 mL and 150 mL depending on the amount of fibres in the suspensions. The suspensions were continuously mixed with a spoon and the sample was taken out at different levels and positions in the beaker with a glass pipette.

Particle size (herein denoted 'Malvern particle size') were measured on the short fraction because much of the material in this fraction was under the detection limit of the Kajaani FS300. Hence, particle size is a better analysis technique than fibre length for samples containing very small particles which is the case for the short fraction. Malvern particle size refers to the particle size measured with Malvern Mastersizer 2000 equipment (using default settings), which uses laser diffraction technique.

The sample was taken out from the suspension as described previously for fibre analysis. Analysis was conducted with default settings.

Gravimetric determination of solid material in each fraction was conducted with the remaining part of the suspension. A Büchner funnel and two 9 mm filter paper (Munktell's, No 0) was used to separate the solid and the liquid phase. The solids and the filter paper at the top were dried at 105° C. for at least 4 h. After that, the weight was determined and the size of the fractions was calculated with corrections for the suspensions used in previous analysis.

Reference examples were also performed wherein the 'Reference pulp I' was the starting softwood cellulose pulp, and 'Reference pulp II' was the starting softwood cellulose pulp which had passed mechanical treatment during 15 minutes.

The result was collected in Table 3, percentage (%) of long and short fractions (mm) and the average fibre length (mm) of these fractions.

TABLE 3

| Sample | Long fraction (%) | Average fibre length (mm) | Short fraction (%) | Average fibre length (mm) |
|---|---|---|---|---|
| Reference pulp I | 68 | 2.83 | 32 | 0.4 |
| Reference pulp II | 59 | 2.77 | 41 | 0.41 |
| Example 5, 5 min | 77 | 2.69 | 23 | 0.44 |
| Example 5, 10 min | 76 | 2.59 | 24 | 0.43 |
| Example 5, 15 min | 77 | 2.42 | 23 | 0.46 |
| Example 6, 10 min | 46 | 2.02 | 54 | 0.42 |
| Example 7, 10 min | 19 | 1.09 | 81 | 0.41 |
| Example 8, 1 min | 59 | 2.26 | 41 | 0.41 |
| Example 8, 3 min | 31 | 1.45 | 69 | 0.45 |
| Example 8, 10 min | 23 | 0.78 | 77 | 0.29 |
| Example 8, 15 min | 20 | 0.79 | 80 | 0.32 |

The result shows the content of long fibres is reduced both by increased mechanical treatment and by increased oxidation treatment.

As said above, the particle size of the short fraction obtained in Examples 5 to 8 were also measured (table 4). D (0, 5) is the size in micrometer (μm) where 50% of the samples are smaller and 50% of the sample is larger. D(0,1) is the size of particles below which 10% of the sample lies. D(0,9) is the size of particles above which 10% of the sample lies.

TABLE 4

| Sample | Short fraction (%, as in table 2) | D(0.1) (μm) | D(0.5) (μm) | D(0.9) (μm) |
|---|---|---|---|---|
| Reference cellulose pulp I | 32 | 15 | 53 | 234 |
| Reference cellulose pulp II | 41 | 17 | 75.6 | 331 |
| Example 5, 5 min | 23 | 16 | 57 | 309 |
| Example 5, 10 min | 24 | 19 | 75 | 309 |

TABLE 4-continued

| Sample | Short fraction (%, as in table 2) | D(0.1) (μm) | D(0.5) (μm) | D(0.9) (μm) |
|---|---|---|---|---|
| Example 5, 15 min | 23 | 25 | 110 | 413 |
| Example 6, 10 min | 54 | 17 | 67 | 292 |
| Example 7, 10 min | 81 | 17 | 73 | 316 |
| Example 8, 1 min | 41 | 23 | 84 | 445 |
| Example 8, 3 min | 69 | 23 | 91 | 488 |
| Example 8, 10 min | 77 | 43 | 109 | 239 |
| Example 8, 15 min | 80 | 22 | 78 | 258 |

At low levels of oxidation, example 5, the size of the particles in the short fraction increases due to the fact that more material has entered the short fraction compared with Reference pulp I. Further, at high level of oxidation, example 8, the entrance of new material into the short fraction is rapid at the beginning, but slower at the end of the mechanical treatment. Because of this the size of the particles is first increased and then after 10 minutes a decrease in size can be seen. At high level of oxidation a large part of the total sample belongs to the short fraction and the size of the particles is small.

Example 10

Freeze Drying

The cellulose pulps were then dried into the final absorbent product. Samples of the pulps obtained in Examples 5 to 8 were all freeze dried. The samples were put in glass beakers and were freeze rapidly in liquid nitrogen. Then the samples were placed in a freeze dryer, pressure 0.3-0.5 mbar, the water were removed by sublimation. The time of drying was 60 hours to ensure that the samples were dry.

The resulting material after the freeze drying was porous material ranging from ordinary fibre networks (lower level of oxidation) to non-transparent foams (higher level of oxidation).

Example 11

BET Surface Area and Total Pore Volume

The BET surface area of the dried product was measured by Micrometrics Tristar 3000. This analyser is an automated gas adsorption analyzer. Samples were first placed in test tubes and pre-treated in inert atmosphere for 3 hours at 25° C. in a Micromeritics Smartprep-programmable degas system. After pre-treatment the test tubes were placed in the analyzer. Nitrogen gas was used in all experiments and the multiple point BET method was used to calculate the BET surface area. Other information about this instrument can be found in the TriStar 3000 manual V6.06. The method to measure the BET surface area is further described in P A Webb and C Orr, Analytical Methods in Fine Particle Technology, 1st ed. Norcross: Micrometrics Instrument Corporation, 1997, and is herein incorporated by reference. The total pore volume in the dried materials was calculated according to the equation below. The dimensions of the dried samples and the dry weight were measured. The density of the solid material of the samples was approximated to 1.6 g/cm$^3$.

$$\text{Total pore volume}(\text{cm}^3/\text{g}) = \frac{\text{Dry sample volume} - \dfrac{\text{Dry sample weight}}{\text{Density(solid)}}}{\text{Dry sample weight}}$$

TABLE 5

BET surface area and total pore volume of freeze dried samples.

| Sample of: | BET surface area m$^2$/g | Total pore volume (calculated) cm$^3$/g |
|---|---|---|
| Freeze dried Reference cellulose pulp I | 15.9 | 120 |
| Freeze dried Reference cellulose pulp II | 21.7 | 120 |
| Example 5, 5 min | 12.7 | 90 |
| Example 5, 10 min | 9.6 | 90 |
| Example 5, 15 min | 7.1 | 90 |
| Example 6, 10 min | 14.9 | 100 |
| Example 7, 10 min | 31.4 | 140 |
| Example 8, 1 min | 30.2 | 100 |
| Example 8, 3 min | 35.7 | 150 |
| Example 8, 10 min | 34.6 | 140 |
| Example 8, 15 min | 64.9 | 190 |

A large surface area indicates that the material has a large area available for absorption of liquids. The result implies that a certain level of oxidation is necessary to be able to increase the surface area compared to the freeze dried reference samples. That level has been reached for the samples of example 7 and 8. It can also be seen that the surface area are favoured by increased level of oxidation and level of mechanical treatment. The total pore volume is mostly dependent on the solid content before the step of freeze drying. Some shrinking during the drying process may also occur. The numbers for the total pore volume has been rounded to the nearest tens.

Example 12

Scanning Electron Microscopy

Figure 1:
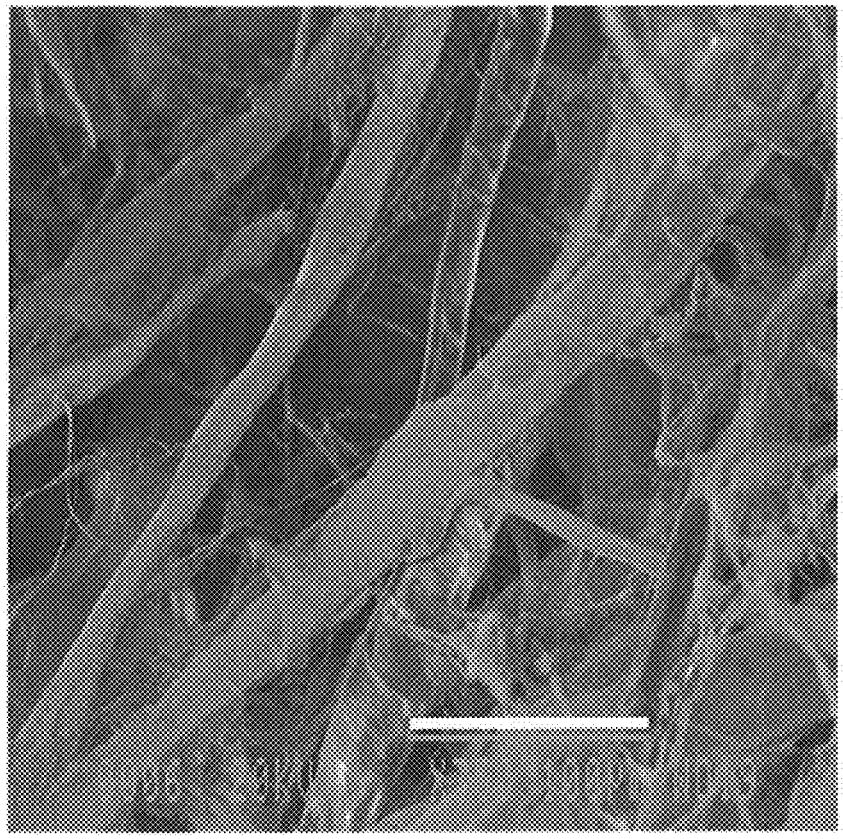
FIG. 1—SEM micrograph of the freeze dried oxidised cellulose pulp as obtained in Example 5, mechanically treated for 10 minutes; magnification 350×, scalebar 100 μm.
Figure 2:
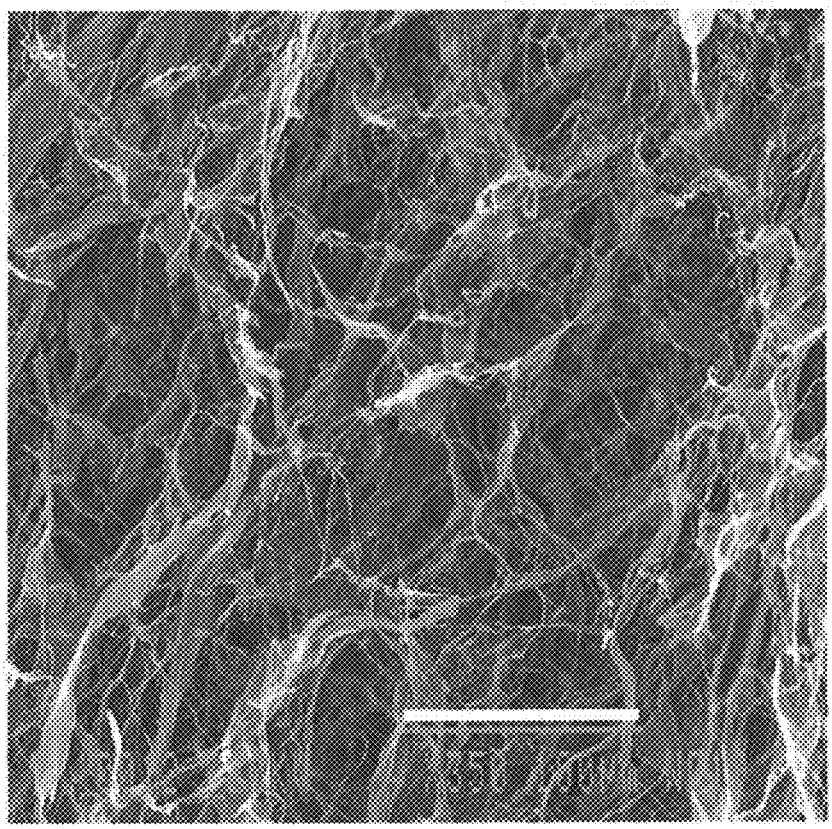
FIG. 2—SEM micrograph of the freeze dried oxidised cellulose pulp as obtained in Example 6, mechanically treated for 10 minutes; magnification 350×, scalebar 100 μm.
Figure 3:
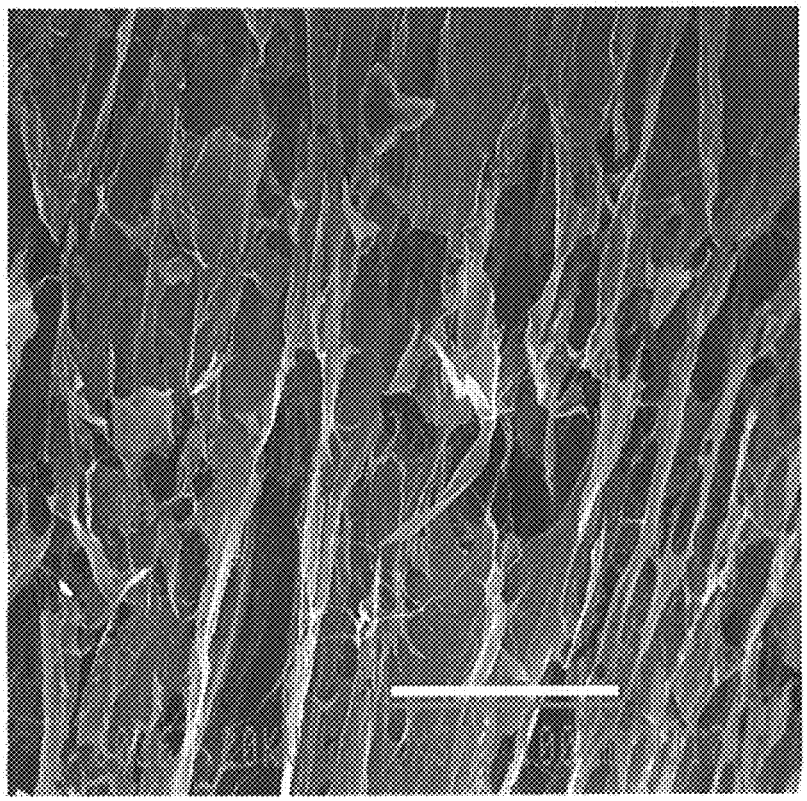
FIG. 3—SEM micrograph of the freeze dried oxidised cellulose pulp as obtained in Example 8, mechanically treated for 10 minutes; magnification 370×, scalebar 100 μm.

Scanning Electron microscopy was used to study the structure of the freeze dried materials. A sample was prepared by first taking out a small sample of freeze dried homogenised tempo oxidised cellulose pulp from a freeze dried sample. Then the surfaces of the sample were sputtered with approximately 20 nm thick layer of gold ions with a JEOL JFC-1100E ion sputter, ion current: DC 10 mA, 3 min. After the coating step, the samples stubs were placed in a JEOL JSM-820 scanning microscope at acceleration voltage of 20 kV. The oxidised cellulose pulp obtained by Example 5 (10 min), Example 6 (10 min), Example 7 (10 min), and Example 8 (10 min), are shown by FIGS. 1, 2, and 3. The SEM micrographs were collected by the JOEL Semafore SA20 slow scan digitalizer and the Semafore 5.1 software.

Example 13

Absorption of Water and Saline Solution

The experiments were conducted in deionised water and some samples also in 1.0% by weight of NaCl solution. The dry weight of the sample was measured. Then, the sample was lowered into a beaker at time zero and was allowed to absorb for 1 min, then the clock was stopped and the sample was taken from the solution, free water were allowed to drip off and the weight was measured. After that the sample was put back into the beaker and the clock was started again. The same procedure was used for the other measurements. The experiments were conducted on the foam as was obtained in Example 8, with mechanical treatment in 15 minutes. Corresponding tests were conducted on compressed foam, the sample of Example 8, 15 minutes the foam was compressed to a volume less than 10% of that of the original foam.

TABLE 6

The values are given as weight of liquid per initial weight of the freeze dried sample.

| Sample liquid\time(min) | 1 | 3 | 5 | 10 |
|---|---|---|---|---|
| Absorption of water: | | | | |
| Example 8, 15 min | 157.6 | 172.6 | 183.8 | 182.0 |
| Example 8, 15 min, compressed water | 48.3 | 93.7 | 121.5 | 140.2 |
| Absorption of saline: | | | | |
| Example 8, 15 min | 121.1 | 148.1 | 152.8 | 140.5 |
| Example 8, 15 min, compressed water | 54.2 | 70.4 | 72.2 | 75.9 |

Example 14

Test of Bonds in Freeze Dried Fibrillar Network

Test of Bonds in Freeze Dried Fibrillar Network

Three samples as defined below were freeze dried and the fibrillar networks were tested:

Sample 1: The cellulose pulp according to Example 8, 15 min.

Sample 2: The cellulose pulp according to Sample 1 but the oxidized pulp was treated with sodium borohydride before the mechanical treatment (to reduce the amount of carbonyl groups).

Sample 3: Cellulose pulp with no oxidation treatment, with 120 min mechanical treatment.

All three samples were put in beakers with a large excess of water. Sample 1 recovered to its original size and shape after an initial shrinkage during the rapid intake of water. The hemiacetal bonds formed in this sample, due to high content of aldehyde groups results in a stable fibril network in the wet state. The size and shape of the sample also recovers after a compression in its wet stage to 20% its height indicating that the fibril network is held together by strong bonds. In sample 2, with a much lower content of aldehyde groups, the sample returned to a gel-like state after wetting. A compression of this network broke the sample into several pieces. Sample 3 were completely dispersed when the sample was wetted. This indicates that this sample do not have bonds to preserve the fibril network in the presence of water.

Example 15

Air Drying

Samples of the pulps obtained in Examples 5 to 8 (1, 3, 5, 10 and 15 minutes as above) were poured out on a plastic plate to produce films with dry surface weight 30 g/m$^2$. The samples were dried in air at room temperature (relative humidity 60%, 21° C.) for four days until the samples were air dry.

The product obtained after the air drying was thin films with different amount of fibres present depending on the treatment during the oxidation step as well as in the mechanical treatment. The samples which had been exposed to high level of oxidation and mechanical treatment were very even and appeared as almost transparent.

The absorption capacity of water and saline solution of the air dried products obtained was measured following the method described in connection with the freeze drying.

TABLE 7

The values are given as weight (gram) of liquid per initial weight (gram) of the air dried sample.

| Sample liquid\time (min) | 1 | 3 | 5 | 10 | 30 | 60 | 90 | 120 | 150 | 180 | 210 | 240 |
|---|---|---|---|---|---|---|---|---|---|---|---|---|
| Absorption of water: | | | | | | | | | | | | |
| Example 5, 5 min | 2.3 | 2.2 | 2.3 | 2.3 | 2.4 | 2.4 | 2.4 | — | | | | |
| Example 6, 5 min | 1.1 | 1.2 | 1.4 | 1.8 | 2.1 | 2.6 | 3.2 | — | | | | |
| Example 7, 5 min | 1.5 | 2.1 | 2.4 | 3.1 | 5.0 | 7.0 | 9.5 | 11.5 | — | 14.9 | 16.5 | 17.7 |
| Example 8, 5 min | 2.9 | 4.1 | 4.9 | 6.4 | 10.5 | 16.5 | 22.7 | 28.3 | 34.0 | 39.4 | — | 44.3 |
| Example 8, 1 min | 2.7 | 3.9 | 4.5 | 6.3 | 10.8 | 13.7 | 14.9 | 14.2 | 14.2 | — | — | — |
| Example 8, 15 min | 3.4 | 5.4 | 6.5 | 8.7 | 15.3 | 25.5 | 34.6 | 44.6 | 53.0 | 61.4 | 61.2 | 61.7 |
| Absorption of saline: | | | | | | | | | | | | |
| Example 8, 5 min | 2.0 | 2.4 | 2.4 | 2.6 | 2.8 | 3.0 | 3.3 | — | — | | | |

From table 7 it is shown that the capacity of the product obtained in Example 8 with 15 minutes mechanical treatment was 61.7. It is clear that for air dried films the water absorption capacity is favoured by high level of oxidation and mechanical treatment during long time.

The absorption capacity tested with saline shows that lower amounts of saline in comparison with water is absorbed.

Example 16

BET Surface Area of Air Dried Films

BET surface area was measured according to Example 11, beside that the single point measurement (at relative pressure 0.30) was used to calculate the BET surface area.

TABLE 8

| Surface area of air dried film | |
|---|---|
| Sample of: | BET surface area ($m^2/g$) |
| Example 5, 5 min | 1.22 |
| Example 6, 5 min | 0.72 |
| Example 8, 5 min | 0.50 |

The result shows that the films have a small BET surface area. This implies that the film are compact and do not have much surface available for absorption of liquids or moisture. Therefore the liquid absorption speed is slower for the air dried films than the freeze dried samples.

Example 17

Preparation of the Composite Material

The Fibres—Starting Material Composite

The softwood kraft pulp was TCF bleached and produced from Scandinavian wood. The CTMP (Canadian standard freeness of 525 mL) and HTCTMP (Canadian standard freeness of 700 mL) were TCF bleached and produced from Scandinavian spruce wood.

A. Softwood Kraft Fibres 94.5 g (o.d.) of wet pulp was disintegrated at 3000 rpm for 10 000 revolutions in three steps (about 30 g in each step). The pulp was transferred to a 0.35×0.45 m box with a nylon web at the bottom. The suspension was stirred and then dewatered, by allowing it to drain for 10 minutes. Water was then removed from the sheet in three steps, with increasing pressure at each step. The first step, which involved putting 3 layers of blotting paper on the sheet and mildly rolling a plastic cylinder over, was done three times. The sheet was then put between new blotting papers and two wooden plates and a pressure of about 5 kPa was applied for about 30 s. Thirdly, it was pressed between new blotting papers and the wooden plates at 0.10 MPa for 7 minutes. The last two steps were done twice. The sheets were then air dried in a restrained condition in a climate room (23° C., 50%). The sheets were then dry disintegrated.

B. CTMP and HTCTMP

The pulps were disintegrated in hot water at 3000 rpm for 30 000 revolutions, dewatered in a Buchner funnel and solvent-exchanged with acetone, to facilitate fibre separation in the mixing.

The specific properties are of the three fibre types are defined in Table 9.

TABLE 9

Fibre properties for the different fibre types used in the composite absorbent materials.

| Pulp | Length (mm) | Width (μm) | Coarseness (μg/m) | Curl (%) | Fines (%) | Bulk (5.2 kPa) ($cm^3/g$) | CRC (g/g) |
|---|---|---|---|---|---|---|---|
| SKP | 2.77 | 26.4 | 223 | 25.1 | 0.8 | 6.7 | 1.5 |
| CTMP | 2.13 | 38.7 | 348 | 15.1 | 3.1 | 8.6 | 2.2 |
| HTCTMP | 2.23 | 36.2 | 391 | 10.7 | 3.0 | 8.7 | 2.0 |

The Composite Absorbent Material

The oxidation and mechanical treatment of the cellulosic pulp were performed as explained in Example 9. Thereafter, the wet absorbent material was mixed with different types of cellulosic pulps.

A stirrer was used to mix the absorbent material with the cellulosic fibers. A fixed amount of absorbent material was used for every sample, so that the amount of fibres determined the ratio of fibres and absorbent material. Stirring was continued until a homogenous suspension was attained.

TABLE 10

The content of fibres for the different pulp types used in the preparation of the composite material.

| Fiber | Fibre content (%) | | | | | | | |
|---|---|---|---|---|---|---|---|---|
| type | 15 | 25 | 50 | 65 | 75 | 80 | 85 | 88 |
| SKP | X | x | X | | X | | x | |
| CTMP | | x | X | X | X | x | x | X |
| HTCTMP | | x | X | | x | | x | |

Samples of absorbent material only and fibre only was also prepared (the samples with fibres only had the same dry weight as the 4 g fibre/g absorbent material). The suspensions were freeze dried as in example 10 (20 g of wet suspension was used for each sample).

Figure 4A:
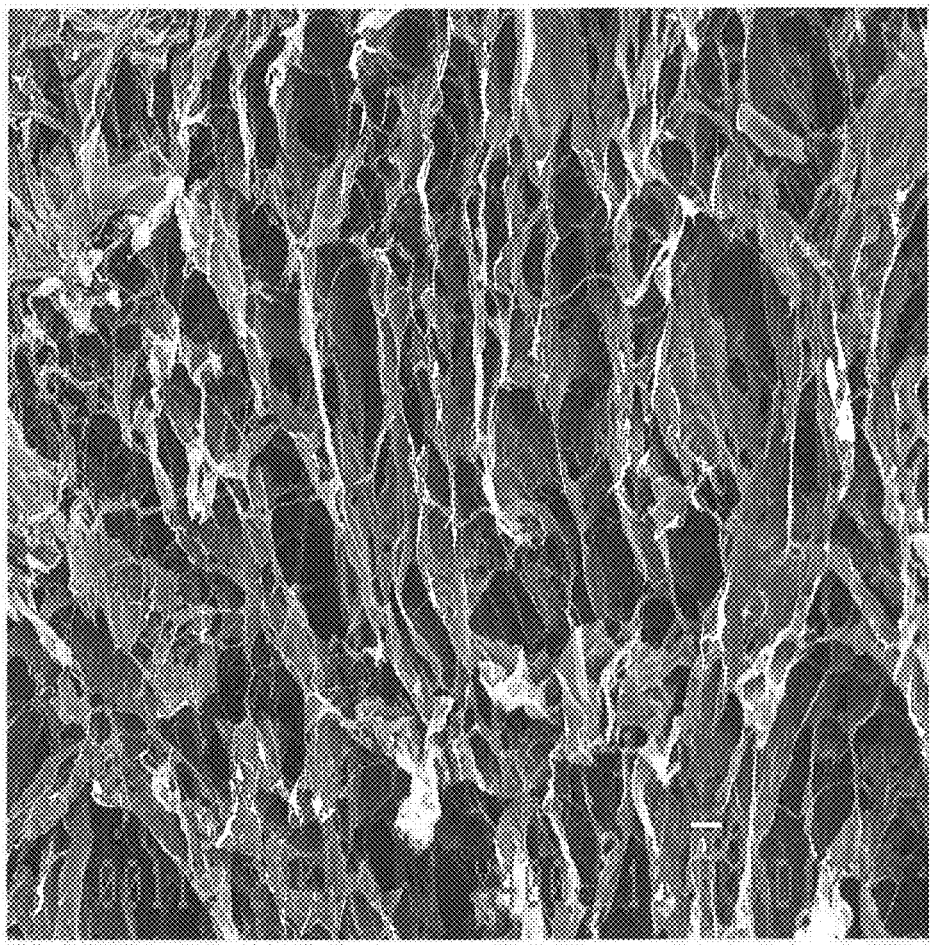
FIG. 4*a*—SEM micrograph of the freeze dried oxidised cellulose pulp fibrillar network as obtained in Example 9 magnification 400×, scalebar 10 μm.

In FIG. 4*a*, the freeze dried oxidised cellulose pulp fibrillar network is illustrated. It can be seen that the structure is highly porous with large surfaces available for absorption of liquid. The fibrillar network is partly covered by thin layers of cellulosic material.

Figure 4B:
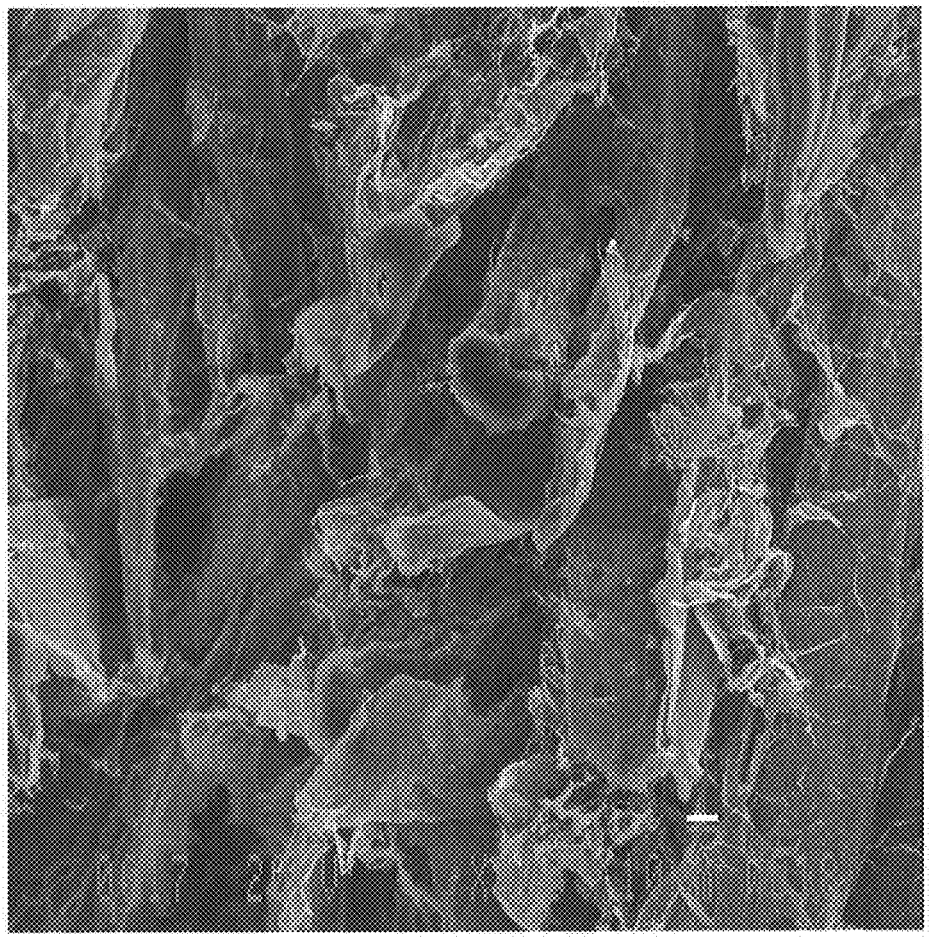
FIG. 4*b*—SEM micrograph of the freeze dried composite material of 85% fibres (Softwood kraft pulp, SKP) and 15% oxidised cellulose pulp fibrillar network as obtained in Example 9 magnification 400×, scalebar 10 μm.
Figure 4C:
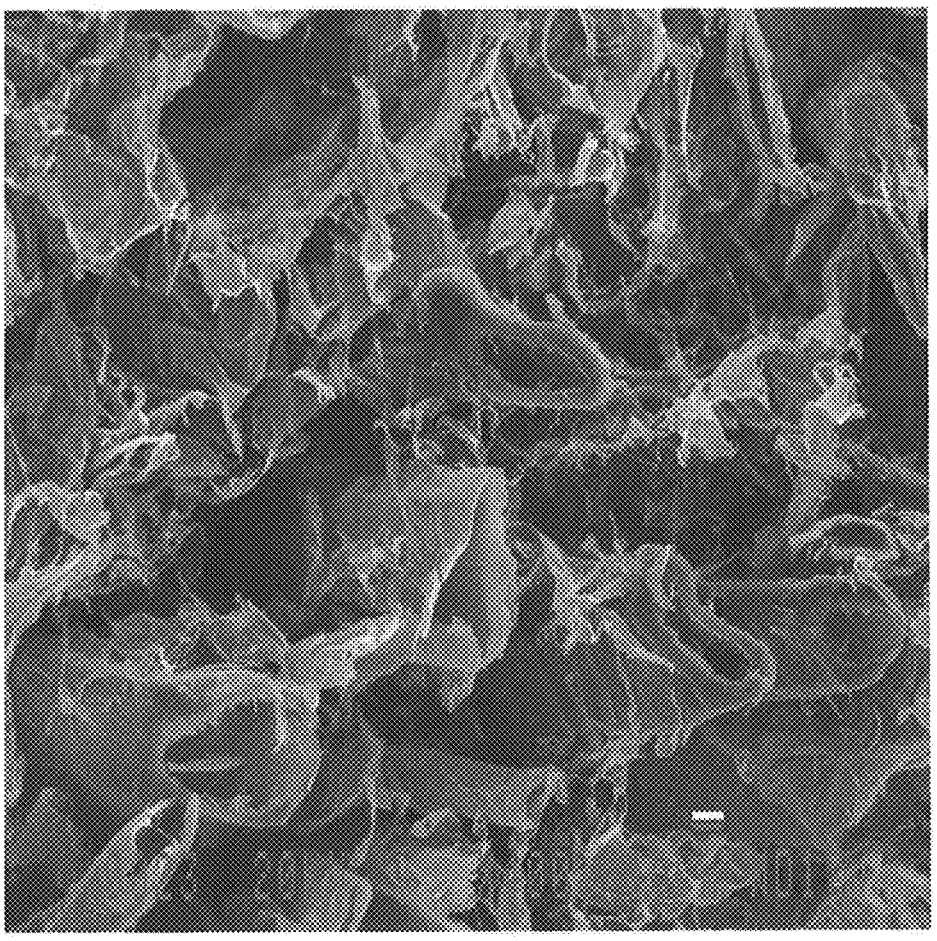
FIG. 4*c*—SEM micrograph of the freeze dried composite material of 85% fibres (CTMP) and 15% oxidised cellulose pulp fibrillar network as obtained in Example 9 magnification 400×, scalebar 10 μm.

In FIG. 4*b* and FIG. 4*c* illustrates the composite material were fibres are embedded in a matrix of absorbent material (the fibrillar network). It can also be seen that the fibrillar network is connected to the surfaces of the fibres. As in FIG. 4*a* the absorbent material has a large surface area and contains small pores. These pores can be preserved to a higher extent when exposed to pressure forces due to the fibres organized in the network structure

Example 18

Wet Bulk

Samples were put into the compression tester where the height of the sample is measured at different pressures. The height together with the diameter (0.44 mm) was used in the calculation of the wet bulk. The wet bulk is the volume of the sample divided by the dry weight of the sample before the compression test. The wet bulk under pressure shows the volume of the samples when wetted and put under a certain pressure and is an indirect measure of the ability of the porous network to retain liquid under pressure. The measurement schedule is shown in table 11.

TABLE 11

The different pressures in the wet bulk test. The height was measured before each change in pressure.

| Time (min) | Pressure (kPa) | State |
|---|---|---|
| 0 | 0.6 | Dry |
| 2 | 0 | Wetting |
| 12 | 0 | Drainage |
| 14 | 0.1 | Wet |
| 16 | 0.6 | Wet |
| 18 | 1.3 | Wet |
| 20 | 2.6 | Wet |
| 22 | 5.2 | Wet |
| 24 | 7.7 | Wet |
| 26 | 12.9 | Wet |
| 28 | 19.4 | Wet |

The freeze dried samples was put in a compression tester and the height was measured at 0.6 kPa. The pressure was then released and an open container with 0.9% saline solution was put under the sample. The sample absorbed water for 10 minutes and allowed to drain off for another 2 min. The pressure was then increased stepwise (as seen in table x) from 0.1 kPa to 19.4 kPa and after two minutes of equilibration at each pressure the height was measured.

FIG. 6 illustrates the wet bulk (at 5.2 kPa) of the composite absorbent material versus the content of fibres in the composite absorbent material. The result of the wet bulk test surprisingly showed that the wet bulk of the composite material was maintained at the same level as the absorbent material if using a fibre content of about 85%. At all fibre contents the wet bulk was much higher than expected considering the low wet bulk value of fibres.

Example 19

Scanning Electron Microscopy of the Composite Absorbent Material

In accordance with Example 12, scanning electron microscopy was used to study the structure of the composite absorbent material. The oxidised cellulose pulp obtained by Example 9 and the fibre-foam compositions obtained by Example 17 are shown in FIGS. 4*a*, 4*b* and 4*c*.

Example 20

Centrifuge Retention Capacity (CRC)

The Centrifuge retention capacity (CRC) were measured according to the standard test Edana 441.1-99.

The CRC values were calculated according to:

$$CRC = \frac{m_{wet(t)} - m_{dry} - m_{bag}}{m_{dry}}$$

where $m_{wet(t)}$ is the wet weight of sample+bag+solution, $m_{dry}$ is the dry weight of the sample, and $m_{bag}$ is the dry weight of the bag.

FIG. 5*a* illustrates the centrifuge retention capacity of the composite absorbent material versus the content of fibres in the composite absorbent material. In FIG. 5*a* it can be seen that the CRC value of the composite materials are decreasing with increased fibre content. However, this decrease is smaller than what was expected due to the reinforcing effect of the fibres, allowing more liquid to be stored in the absorbent part of the composite material.

Example 21

Centrifuge Retention Capacity 2 (CRC2)

CRC was measured as in example 20. The samples tested were samples of fibres only, absorbent material only and composite materials with various amounts of fibres. The measured values of CRC were then used for calculation of CRC2 (see formula below). CRC2 shows the retention capacity of the absorbent material if the improved capacity of the composite material is totally assigned to the absorbent material. This assumption is reasonable due to limitations for fibres to retain a large amount of liquid. In the formula it can be seen that contribution to the CRC from fibres only are subtracted and so are the weight of the fibres. Thereby the CRC2 can be defined as the CRC of the absorbent material when used together with fibres in the composite material of the invention.

$$CRC2=((CRC\times m)_{composite}-(CRC\times m)_{fibres})/(m_{composite}-m_{fibres})$$

FIG. 5*b* illustrates the centrifuge retention capacity of absorbent material when it has been combined with fibres in a composite absorbent material versus the fibre content. This unexpected positive effect by adding fibres to the absorbent material are more clearly illustrated when subtracting the contribution from fibres. It can be seen that softwood kraft pulp (SKP) is preferable at low fibre contents while CTMP and HTCTMP is preferable at high fibre contents. This results shows that addition of fibres gives a more efficient utilization of the retention capacity of the absorbent than the absorbent material without any fibre addition.

Having now fully described this invention it will be appreciated by those skilled in the art that the same can be performed within a wide range of equivalent parameters. The variations to the disclosed embodiments can be understood and effected by those skilled in the art in practicing the claimed invention, from studying the disclosure and appended claims, and without departing from the gist and scope of the invention and without undue experimentation. This application is intended to cover any variations, uses, or adaptations of the invention following, in general, the principles of the invention and including such departures from the present disclosure as come within known or customary practice within the art to which the invention pertains and as may be applied to.

The invention claimed is:

1. A process for producing an oxidised cellulose pulp fibrillar network, comprising:

(a) oxidising a cellulose pulp with an oxidising agent to obtain about 0.5 to about 2.2 mmol carboxylic groups per gram of the cellulose pulp; and about 0.1 to 5.0 mmol aldehyde groups per gram of the cellulose pulp;

(b) homogenisation of the cellulose pulp of step (a) wherein cellulose fibres of the cellulose pulp are refined to provide 0-50% of the cellulose fibres having a 'Kajaani fibre length' of 0.7 mm-2.1 mm; and 50-100% of the cellulose fibres having a 'Malvern particle size' of 0.05-500 micrometer (μm); and optionally (c) combining with lignocellulosic fibres.

2. The process according to claim 1, further comprising:

(d) drying a product of the homogenisation provided by step (b) or a product of the combining provided by step (c).

3. The process according to claim 1, wherein step (a) comprises the following steps:

1) providing a solution comprising the oxidising agent;

2) adding a cellulose pulp suspension;

3) adjusting a pH of the suspension obtained to be between about 8 to 13 by adding an alkali agent; and 4) adding to the suspension a catalytic amount of a catalytic agent.

4. The process according to claim 1, wherein step (c) comprises the following steps:

(1) providing lignocellulosic fibres having a fibre length of at least about 0.5 mm;

(2) adding the lignocellulosic fibres of (1) to the homogenised cellulose pulp of step (b).

5. The process according to claim 1, wherein a concentration of the oxidising agent is about 0.5 to 50 mmol/g of the cellulose pulp (oven dried).

6. The process according to claim 3, wherein the oxidising agent is selected from the group consisting of lithium hypochlorite (LiOCl), potassium hypochlorite (KOCl), sodium hypochlorite (NaOCl) and calcium hypochlorite ($Ca(OCl)_2$).

7. The process according to claim 3, wherein the catalytic amount of the catalytic agent is about 0.005-5 mmol/g of the cellulose pulp (o.d.).

8. The process according to claim 3, wherein the catalytic agent is 2,2,6,6-tetramethylpiperidin-1-oxyl (Tempo).

9. The process according to claim 3, wherein the solution of step 1) further comprises a co-catalyst.

10. The process according to claim 9, wherein a concentration of the co-catalyst is 0.005-50 mmol/g of the cellulose pulp (o.d.).

11. The process according to claim 1, wherein the lignocellulosic fibres in step (c) are obtained from thermomechanical (TMP) pulping process, chemi-thermomechanical (CTMP) pulping process, high temperature chemi-thermomechanical (HTCTMP) pulping process, or chemical pulping process.

12. The process according to claim 1, wherein the lignocellulosic fibres are added in an amount of 50-90% of a total weight of the cellulose pulp.

13. The process according to claim 2, wherein the drying is performed by freeze drying.

14. The process according to claim 2, wherein the drying is performed by air- or gas drying.

15. An oxidised cellulose pulp obtainable by the process as defined in claim 1.

16. A cellulosic absorbent product or cellulosic composite absorbent product obtainable by the process as defined in claim 2.

17. The process according to claim 1, wherein a concentration of the oxidizing agent is about 1 to 30 mmol/g of the cellulose pulp (oven dried).

18. The process according to claim 3, wherein the catalytic amount of the catalytic agent is about 0.01-3 mmol/g of the cellulose pulp (o.d.).

19. The process according to claim 9, wherein a concentration of the co-catalyst is 0.5-20 mmol/g.

20. The process according to claim 9, wherein a concentration of the co-catalyst is 0.2-10 mmol/g.

21. The process according to claim 1, wherein the lignocellulosic fibres are added in an amount of 70-90% of a total weight of the cellulose pulp.

22. An oxidised cellulose pulp fibrillar network suspension, comprising:

a cellulose pulp including about 0.5 to about 2.2 mmol carboxylic groups per gram of the cellulose pulp; and about 0.1 to 5.0 mmol aldehyde groups per gram of the cellulose pulp;

wherein the cellulose pulp includes 0-50% of fibres having a 'Kajaani fibre length' of 0.7 mm-2.1 mm; and 50-100% of fibres having a 'Malvern particle size' of 0.05-500 micrometer (μm).

23. The oxidised cellulose pulp fibrillar network suspension as defined in claim 22, wherein at least 50% of the cellulose pulp is of a short fraction and that 50% of this short fraction has a particle size of less than 120 μm; and 90% of the short fraction has a particle size of less than 400 μm.

24. A cellulosic composite absorbent product comprising:

an oxidised cellulose pulp fibrillar network, wherein a cellulose pulp of the oxidised cellulose pulp fibrillar network comprises about 0.5 to about 2.2 mmol carboxylic groups per gram of the cellulose pulp; and about 0.1 to 5.0 mmol aldehyde groups per gram of the cellulose pulp; and wherein the cellulose pulp comprises 0-50% of fibres having a 'Kajaani fibre length' of 0.7 mm-2.1 mm; and 50-100% of fibres having a 'Malvern particle size' of 0.05-500 micrometer (μm); and lignocellulosic fibres having a fibre length of at least 0.5 mm.

* * * * *